United States Patent [19]

Maqueira

[11] Patent Number: 4,736,476

[45] Date of Patent: Apr. 12, 1988

[54] WALL BED MECHANISM

[76] Inventor: Benigno Maqueira, 9900 Adleta Blvd., #524, Dallas, Tex. 75243

[21] Appl. No.: 26,761

[22] Filed: Mar. 17, 1987

[51] Int. Cl.[4] ..... A47C 19/06

[52] U.S. Cl. ..... 5/136; 5/164 R; 5/164 D

[58] Field of Search ..... 5/133, 136, 162, 164 R, 5/164 C, 164 D

[56] References Cited

U.S. PATENT DOCUMENTS 3,851,344 12/1974 Zeithammer ..... 5/164 D

FOREIGN PATENT DOCUMENTS 503809 6/1951 Belgium ..... 5/164 D 2606040 8/1977 Fed. Rep. of Germany ..... 5/164 R

*Primary Examiner*—Alexander Grosz

*Assistant Examiner*—Michael F. Trettel

[57] ABSTRACT

An improved wall bed lifting mechanism for providing the support and pivotal motion of both a bed and headboard structure of conventional design about a transverse axis wherein the mechanism accommodates the storing of a bed and fixed headboard in vertical relation to the floor and adjacent to the wall, and, the rotation of the wall bed and headboard into horizontal relation with the floor for usage. The mechanism comprises a lifting assembly which is independently structured and, both attached to the frame of the bed and pivotally mounted on a support frame. The support frame is fixed to a wallbed cabinet, for the successive lifting and recessing of the bed structure and is activated or operated by application of pressure to the foot of the bed by a user, either lifting the bed for storage or pulling the bed out from storage into the reclining position. A spring mechanism extends from the lifting assembly to the support frame, such that the spring mechanism is placed under tension as the bed rotates into the reclining position, and relaxes as the bed rotates into the storage position thereby assisting a user in storing the bed and acting to prevent the bed from independently shifting into the reclining position.

14 Claims, 2 Drawing Sheets

WALL BED MECHANISM

BACKGROUND OF THE INVENTION

1. Field of the Invention

This invention relates to a wall bed, and more particularly to a wall bed lifting mechanism.

2. Description of the Prior Art

In conventional, modern-day sleeping facilities, it is common to have a wall bed including a substantially rectangular shaped support dimensioned and configured to allow a user to be supported in horizontal relation to the surface of the floor, and a mechanism to rotate the bed from a position adjacent to the wall and vertical to the floor when not in use to a position perpendicular to the wall and horizontal to the floor. Furthermore, in some cases, a folding headboard may be accommodated by wall bed mechansims of the prior art.

While the wall bed and folding headboard structure are in common usage, it is also well recognized that it may be preferable, and perhaps more stable, to provide a wall bed with a fixed headboard positioned in standard relation to the head of the bed.

In order to overcome the above set forth problem of positioning a wall bed without a headboard, or with a folding headboard, in both operational and storage positions, the prior art is replete with numerous "folding mechanisms" capable of positioning the bed structure in horizontal relation to the floor from a position adjacent to the wall and vertical to the floor with use of the hands. However, devices of the type referred to, in some instances, may be cosidered overly complicated and/or somewhat limited in their operation at least partially based on the fact that such structures either do not accommodate a headboard or may accommodate only a folding headboard thereby lacking the versatility of providing a substantially rigid headboard structure.

Accordingly, there is a need for a device which is structured to be versatile in its operation to the extent of being capable of positioning a wall bed and fixed headboard structure between the aforementioned storage or operational position while maintaining the feature of requiring nominal storage space adjacent to the wall.

In addition, such a preferred wall bed mechanism should be capable of reducing complexity in design, operation, maintenance, and, installation, while accommodating suitable stability and durability which shall be described in greater detail hereinafter.

SUMMARY OF THE INVENTION

The present invention is directed to a wall bed mechanism specifically designed to be used in combination with a wall bed and fixed headboard structure and more specifically to be mounted at the head of a wall bed. In operation, the wall bed mechanism of the present invention is structured to vertically rotate the wall bed and fixed headboard structures for storage adjacent to a wall surface when it is not desired to lie on the bed structure. The subject mechanism enables the lifting of the aforementioned wall bed and headboard structure with a simple pulling motion outward from the wall at the foot of the bed.

More specifically, the subject wall bed mechanism comprises a support frame including a mounting member dimensioned and configured to extend behind the headboard and onto the exposed face of the wall mounting frame. Through the incorporation of elongate screw elements, the support frame allows the subject wall bed mechanism to be readily adaptable to each, individual wall bed permitting proper pivotal operation of the wall bed from the secured to the operational position. In the preferred embodiment, two wall bed mechanisms are oriented equi-distant from the sides of the bed to provide stability and reduce stress on an individual mechanism.

One independently disposed and structured lifting assembly is provided and centrally positioned behind the headboard and into the base of the bed for assisting in lifting the bed when force is applied by a user to rotate the bed back into the vertical, storage position and for retaining the bed in the storage position until a user applies force to pull the bed into the horizontal or reclined position.

More specifically, the lifting assembly includes a strut system supporting the bed platform and headboard connected by appropriate linkage to the support frame wherein the linkage is placed under tension as the bed is outwardly extended. The tensioned linkage is designed to be of sufficient force to support a portion of the weight of the bed, but not enough to cause the bed to pivot into the upright position without additional force from a user. The tensioned linkage acts to assist a user in lifting the bed into the storage position when force is applied to lift the bed, and to maintain the bed in the upright position when not in use.

Ancillary structures associated with the subject lifting mechanism includes an adjustable support apparatus pivotally connected to the support frame providing fine adjustment of the bed frame in the bed cabinet in order to assure free movement of the bed into and out of the wall bed cabinet; and, an adjustable rear support bracket for providing additional securing of the support frame to the wall bed cabinet. Yet another feature of the present invention is the ability to adjust the tension of the tension linkage by means of the elongate screws extending to the forward edge of the wall bed cabinet.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts thoughout the several views of the drawings.

DETAILED DESCRIPTION OF THE PREFERRED EMBODIMENT

Figure 1:
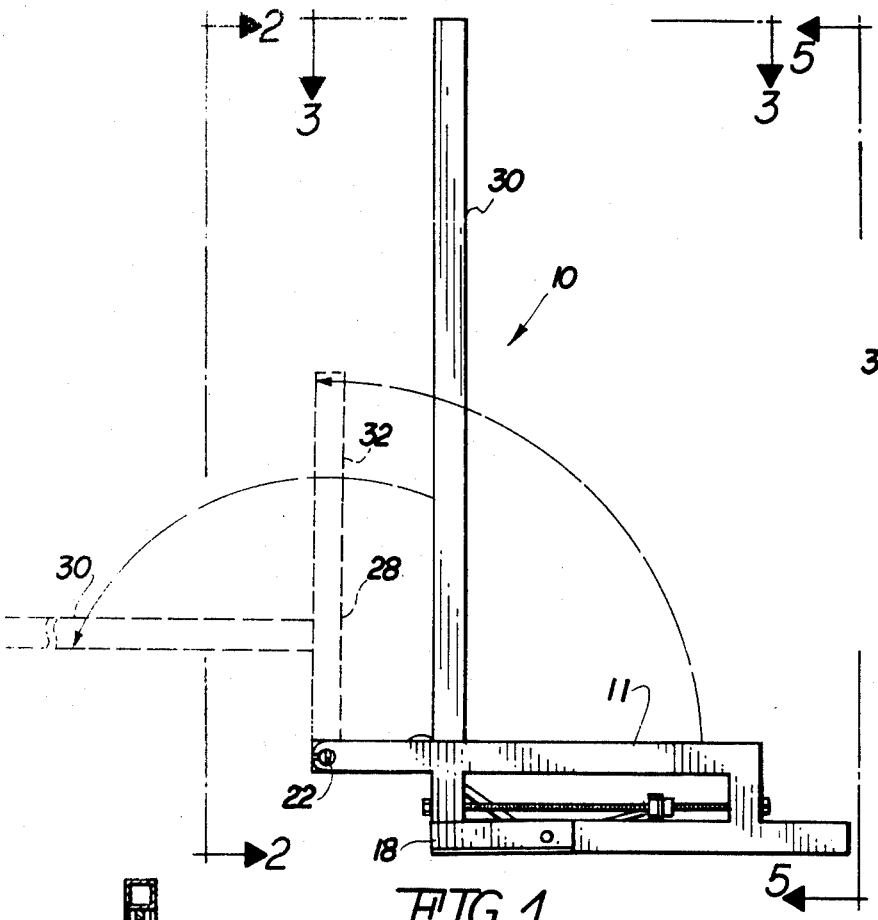
FIG. 1 is a side perspective view of the improved wall bed mechanism of the present invention in the storage position with the operational position and motion being displayed in partial cutaway by dashed lines and arrows.
Figure 2:
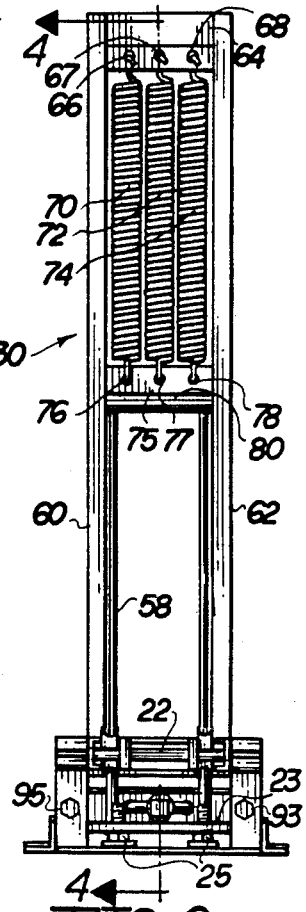
FIG. 2 is a detailed front view of the wall bed mechanism of the present invention as shown along the lines of 2—2 in FIG. 1.

As shown in FIGS. 1 through 6, the present invention is directed towards an improved wall bed lifting mechanism generally indicated as 10 comprising a support frame 11 including two longitudinal sides or trusses 12 and 14. The trusses 12 and 14 are connected by spacer bars 16 and 17 at one end, a mounting member 18 at a forward location designed to reach nearly flush to the front lip of a wall connected cabinet 20 (as shown in FIG. 7), a shaft member 22, and, wedge bar 23 (FIG. 2). The mounting member 18 has at least two apertures 24, dimensioned and relatively disposed, to accommodate connecting members, such as the bolts normally associated with a mounting member 18 and cabinet assembly 20 generally indicated as in FIGS. 7 and 8. The connecting bolts, while not clearly shown, are common to most modern-day wall bed assemblies and are generally used to secure the folding bed mechansim 10 to the wall bed cabinet 20 and more particularly, to an exposed upper face thereof 26, thus, preventing lateral or longitudinal motions of the support frame 11 during the bed raising and lowering stages. The mounting member 18 is pivotally connected to the support frame 11 by means of a pin 108 which permits pivotal motion about holes 110 and 112 such that the pivot point of pin 22 can be raised or lowered while the lifting mechanism 10 remains secured to cabinet 20. These adjustments are accomplished via bolts 25 (FIG. 2) which engage into wedge bar 23 with mating threaded holes and act against the spacer bar 17 to provide the installer a means of adjusting the side gaps 33 (FIG. 8) between the platform edges and cabinet sides while the bed is in the upright stored position. The aft end of the support frame 11 is secured to cabinet assembly 20 prior to securing the mounting member 18 by sliding back the entire lifting mechanism 10 while in the upright position until the spacer bar 16 is slipped under the clamping bracket 27 and secured in place by a screw 29 is threaded through a hole 25 into abutting relation with spacer bar 16 (FIG. 7). Clamping bracket 27 has a central portion and the two distal portions that are attached to an interior base portion of the cabinet. The central portion is L-shaped in cross section so that the spacer is slid under a horizontal leg, with a vertical leg of the bracket abutting the rear interior wall of the cabinet. The threaded hole 25 is centrally located on the central portion. The distal portions of the clamping bracket 27 are L-shaped so as to provide mounting feet for the bracket 27. A vertical portion of each distal portion can abut the side of the support frame 11, while a horizontal portion can include a hole for engagement with a nut and bolt for attaching the bracket to the cabinet interior.

Figure 7:
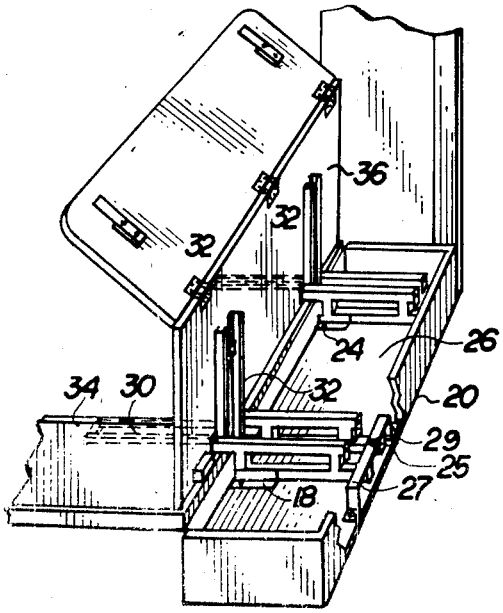
FIG. 7 is a side plan view in partial cutaway of dual wall bed mechanisms in position affixed to the wall frame and the wall bed with the wall bed in the operational position.
Figure 8:
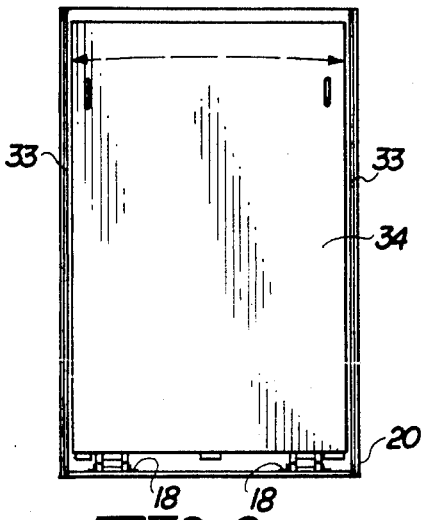
FIG. 8 is a frontal view of dual wall bed mechanisms in position affixed to the wall bed and wall frame with the wall bed in the storage position.

Accordingly, while the mounting member 18 serves to fix and securely attach the support frame 11 in the position shown in FIGS. 7 and 8 to the wall bed cabinet 20, the rotating structure 28 is pivotally secured by the shaft 22 in substantially overlying relation to the lip of the exposed upper face 26 of the wall bed cabinet 20. Such pivotal movement into and out of overlying relation with the support frame 11 and between the covering relation shown in solid lines and the upright or open position shown in phantom lines in FIG. 1 is thereby possible, and, reflects the storage position (bed completely inside cabinet) and the user position (head board flush with face of the cabinet) of the wall bed, respectively.

Figure 6:
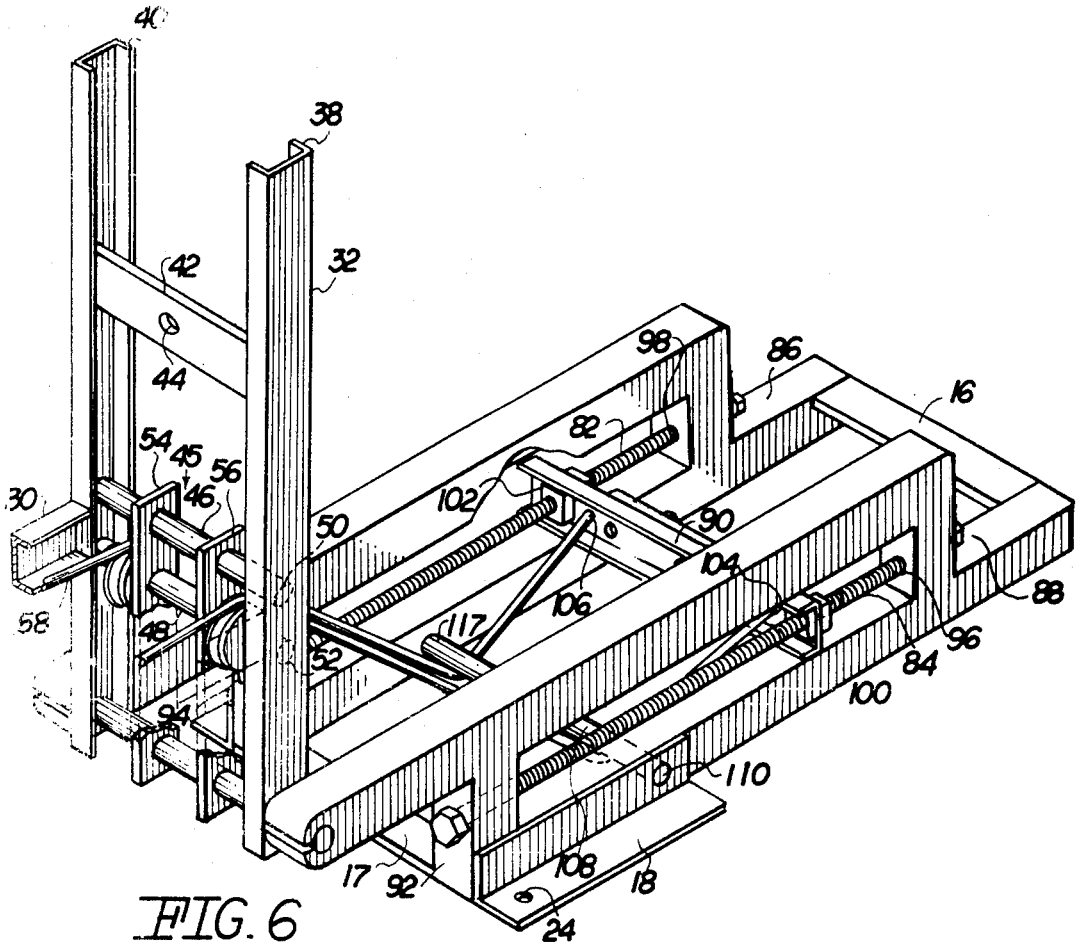
FIG. 6 is a detailed side plan view of the wall bed mechanism in the operational position and in partial cutaway.

With reference to FIGS. 1, 6, and 7, the rotating structure 28 includes a lifting strut 30 and a support strut 32 upon which a bed platform 34 and headboard 36 are mounted. The support strut 32 comprises two parallel U-beams 38 and 40 rotatably connected to the rod 22. A bar 42 is fixed in perpendicular relation to the U-beams 38 and 40, as by welding, to provide a primary function of securing the rotating structure 28 to the bed platform as by a nut and bolt (not shown) inserted through the hole 44 and into the headboard 36 as best shown in FIG. 7, and, a secondary function of maintaining the parallel relation of the U-beams 38 and 40.

With continuing reference to FIG. 6, a pin assembly 45 is fixed into position on said U-beams 38 and 40 about the lifting strut 30 as by insertion through holes 50 and 52 of two pins 46 and 48. Mounted on said pins are two pulley mechanisms 54 and 56 through which a tension rope 58 extends along a portion of the length of the lifting strut 30.

Figure 3:
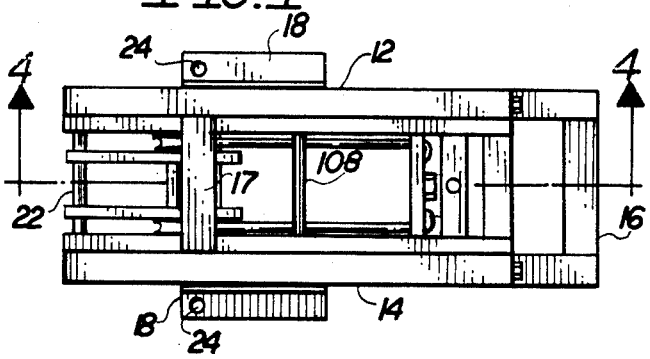
FIG. 3 is a detailed overhead view of the wall bed mechanism of the present invention as shown along the lines 3—3 of FIG. 1.
Figure 5:
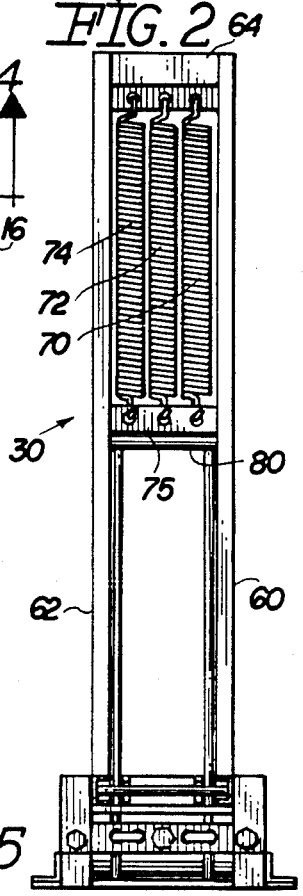
FIG. 5 is a detailed rear view of the wall bed mechanism of the present invention as shown along the lines of 5—5 in FIG. 1.

As best shown in FIGS. 2, 3, and 5, the lifting strut 30 includes a pair of parallel U-beams 60 and 62 perpendicularly extending from the U-beams 38 and 40 and fixed as by welding in engaging relation to said U-beams 38 and 40. At the far end of the U-beams 60 and 62, a bar 64 is fixed, as by welding, and, serves a dual function of maintaining the spacing between said U-beams 60 and 62 and fixing one end of three springs 74, 72, and 70 as through holes 66, 67, and 68. In usage, the lifting strut 30 inserts into the bed platform 34 (as shown by dotted lines in FIG. 7) and has sufficient length to act as a lever to both hold the head of the bed in a set spaced relation to the floor when in use and to apply lift to the bed so as to counter-balance the bed's weight upon proper application of spring tension as the bed is placed into its storage position.

Figure 4:
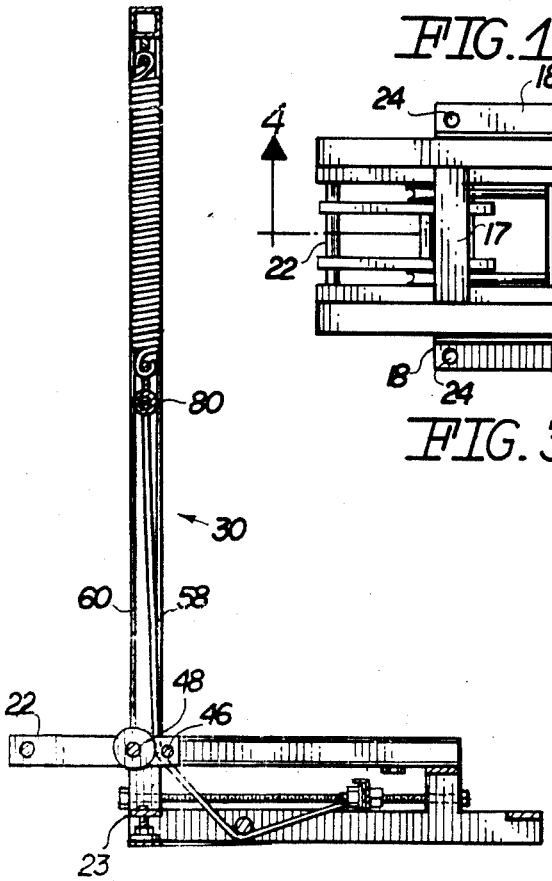
FIG. 4 is a side plan view of the wall bed mechanism in partial cutaway along the lines 4—4 of FIG. 3.

Referencing FIGS. 2, 4, and 5, the springs 70, 72, and 74 act to provide tension on the lift strut 30 as the bed is rotated into the usable position (as shown in FIGS. 1 and 7) by an interconnection of the spring ends to a slidable bar 5 as through holes 76, 77, and 78, and the connection of the bar 75 to the tension rope 58 as by looping through the hollow circular end 80. Then tension rope, as previously discussed, extends through two pulley mechanisms 54 and 56 at the interconnection area of the lift strut 30 and the support strut 32. The tension rope 58, which may be constructed of steel wire cable, is connected at an adjustable location to the support structure 11.

The result being that with the tension rope 58 properly adjusted, the springs 70, 72 and 74 will be relaxed when the bed is in its storage position as depicted in FIGS. 3, 4, and 5; and, as the bed is pulled into its usable position, the springs 70, 72, and 74 will be extended into a tension position. When a user seeks to lift the bed into its storage position, the springs 70, 72, and 74 will assist the user in lifting the bed as the springs seek to release their tension. Under the operation of the wall bed mechanism, the springs will further act to maintain the bed in its storage position until such time as a user applies pressure against the springs to pull the bed back into its usable position.

Referencing FIGS. 1 and 6, the tension rope 58 may be adjusted according to the needs of the particular bed to obtain proper tension operation of the springs by eliminating the center spring 72 and/or adjustment of screws 82 and 84 extending through holes 92, 94, 96, 98, sized and spaced both fore and aft on the support structure 11 (as best depicted in FIG. 6), and having the heads 86 and 88 of said screws, sized larger than said aft holes 96 and 98, acting to prevent the sliding forward of said screws 82 and 84. An adjustable bar 90 engages said screws 82 and 84 with mating threaded holes 100 and 102 and is movable, both for and aft for adjusting the tension of the tension rope 58 by turning the screws 82 and 84 from the readily accessible ends 93 and 95 with a screwdriver. In order to facilitate this adjustable feature the tension rope 58 is looped as through holes 104 and 106. Said holes 104 and 106 are located in a wider relationship with respect to each other than the pulley mechanism 54 and 56 in order to prevent binding and twisting of the tension rope 58. A roller 108 is further fixed to the support frame 11 and recessed beneath the bar 90 as through holes 110 and 112 to further enable the tension rope 58 to maintain a suitable relationship between the bar 90 and pulleys 54 and 56 in order to facilitate the motion of the support strut as it is retracted and extended on the pivot bar 22.

While a preferred embodiment of this invention has been described, it will be recognized that other embodiments, incorporating modifications of this invention but retaining the principles of the invention may be made. It is therefore to be understood that the following claims are intended to cover all of the generic and specific features of the present invention herein described, and all statements of the scope of the invention which as a matter of language, might be said to fall there between.

Now that the invention has been described,

What is claimed is:

1. A lifting mechanism for supporting and accommodating pivotal motion of a wall bed into the reclining and storage positions with respect to a wall bed cabinet having an interior base portion to which the wall bed is affixed, said mechanism comprising a support means including a first pair of longitudinal struts spaced a first pre-determined distance apart; each first strut having an upper and lower portion, inner and outer surface, and, forward and rearward vertical support portions, said inner surface of each strut facing the respective inner surface of the other strut; said upper and lower portions having forward and rearward portions; said forward portions having leading forward edges, and said rearward portions having leading rearward edges, said leading forward edge of the upper portions being spaced a second pre-determined distance forward of said leading forward edge of the lower portions; said leading rearward edge of the lower portions being spaced a third pre-determined distance rearward of said leading rearward edge of the upper portions; said forward and rearward vertical support portions spacing the upper and lower portions a fourth pre-determined distance apart;

said leading forward edges of the lower portions having a first width-wise portion bridging said first pre-determined distance, said first width-wise portion including a spacing means; said first width-wise portion having an upper and lower surface, a pair of threaded holes symmetrically spaced between said first struts and connecting the upper and lower surface, and, a pair of bolt-like members mating with said holes, said bolt-like members having bolt heads adjustable with a wrench or similar device, said bolt heads being adjustable spaced beneath the lower surface of the first width-wise portion;

said leading rearward edges of the lower portions having a second width-wise portion bridging said first pre-determined distance;

said vertical portions having forward and rearward surface, holes spaced a fifth pre-determined distance between the upper and lower portions and connecting the forward and rearward surfaces, and, elongate bolts and frozen nuts connecting the respective rearward surface of the rearward vertical support, said holes being sized to accommodate the free turning of the bolts;

a first pivot means;

a first attachment means securing the support means to said interior base portion of the wall bed cabinet;

a rotating structure, attaching to the base of said wall bed and pivotally attached to the support structure by said first pivot means;

a first guide means; and, a tensioning means connecting said rotating structure and said support means to provide tension on the rotating structure as said structure is disposed from a first degree relation to a second degree relation with respect to said support means;

said first guide means guiding said tensioning means as the rotating structure is disposed from the first to second degree relation;

whereby said rotating structure accommodates pivotal motion of the wall bed about an axis along said first pivot means and above said cabinet base portion so that the rotating structure assumes the first degree relation when the wall bed is stored in the wall bed cabinet, and assumes the second degree relation under increasing tension as the wall bed assumes the reclining position.

2. A mechanism as claimed in claim 1, said support means including an adjustable width-wise section adjustably mating through nut or other threaded means said elongate bolts, such that as said bolts are adjusted with adjustment means, said adjustable section is moved forward or rearward between the vertical supports.

3. A mechanism as claimed in claim 2, said first attachment means securing the lower, forward portion of the first struts to said interior base portion of the wall bed cabinet, and, comprising a pair of L-shaped longitudinal members, respectively, spaced in abutting relation with the outer surfaces of the first struts and pivotally attached to said struts by said second pivot means.

4. A mechanism as claimed in claim 3, each longitudinal member of said first attachment means having an upper, lower, forward, and rearward portion, said lower portion extending away from the respective outer surface of the first struts, and, having a lower and upper surface and a hole connecting the lower and upper surface of the longitudinal member, said lower surface designed to the placed in flush relation with said interior base portion, and said hole being sized to accommodate a bolt for securing the first attachment means to said interior base portion of the wall bed cabinet; said upper portion having an inner and outer surface and a hole connecting the inner and outer surface, said hole being spaced along the rearward portion of the longitudinal member, said inner surface spaced in flush relation to said outer surface of the respective first struts and said hole being sized to fixedly mate with said second pivot means.

5. A mechanism as claimed in claim 1, said first pivot means comprising a first pin; said first pin bridging said first pre-determined distance and rotatably attached to said leading forward edges of the upper portions.

6. A mechanism as claimed in claim 1, said support means including a second pivot means comprising a second pin, said second pin bridging said first pre-determined a sixth pre-determined distance rearward of the leading edge of the lower portion.

7. A mechanism as claimed in claim 1, said support means including a second attachment means securing the leading rearward edge of the lower portion of the first struts to said interior base portion of the wall bed cabinet, and comprising an L-shaped bracket member including means for securing the bracket member to the interior base portion of the wall bed cabinet; said bracket member having a central and two distal portions, said central portion having an L-shape a horizontal surface for abutting relation with the rearward, lower portion of the first struts, and a vertical portion for abutting relation with a rear, interior wall of the wall bed cabinet; said horizontal surface of the central portion having an upper and lower face, a threaded hole centrally located and connecting the upper and lower face, and, a bolt threaded for mating engagement with said hole for adjustable engagement with the rearward, lower portion of the first struts; said distal portions having an L-shape, a vertical face sized to abut the respective outer surfaces of the first struts, and a horizontal portion including a hole, said horizontal portion being sized to engage the interior base portion in flush relation, and said hole being sized for mating engagement with a bolt and nut for securing the bracket to the interior base portion in flush relation.

8. A mechanism as claimed in claim 1, said rotating structure comprising a second pair of longitudinal struts spaced a seventh pre-determined distance apart less than said first pre-determined distance.

9. A mechanism as claimed in claim 8, each second strut of said rotating structure having a proximal and distal end, and, an inner and outer side; said inner side having a slot extending longitudinally;

said inner side of each second strut facing the inner side of the other second strut;

a first width-wise portion bridging said seventh pre-determined distance at said distal end of the second struts and including a first securing means; said first securing means comprising three symmetrically spaced holes between the inner sides;

a first width-wise section bridging said seventh pre-determined distance and being slidable within said slot of the second struts; said first width section including a second and a third securing means; said second securing means comprising three symmetrically spaced holes on the first width section, between the inner sides and corresponding to said three holes on said first width portion; said third securing means comprising two symmetrically spaced holes between the inner sides and corresponding to the proximal end of the second struts.

10. A mechanism as claimed in claim 1, said rotating structure comprising a third pair of longitudinal struts spaced a seventh pre-determined distance apart, fixed in perpendicular relation to said second struts at a fixation point, and pivotally connected to the support means by the first pivot means.

11. A mechanism as claimed in claim 10, each of said third struts having a proximal and distal end, and, an inner and outer side; said inner side of each strut facing the inner side of the other; said third strut including a hole connecting the inner and outer side at the proximal end, said holes being sized to mate with said first pivot means and permit free rotation of said rotating structure from a first degree relation to a second degree relation with respect to the first struts;

said fixation point being located nearer to the proximal than the distal end of the third struts;

a second width-wise portion bridging said seventh pre-determined distance adjacent the fixation point and towards the proximal end of the third struts; said second width portion comprising a rod and two rollers spaced adjacent respective inner sides of the third struts; said rollers having free rotation about the third width portion;

a third width portion adjacent the second width portion and towards the distal end of the third struts; said third width portion comprising a rod;

a fourth width-wise portion bridging said seventh pre-determined distance and including a securing means, said securing means comprising a hole centrally located between the inner sides and facing perpendicular to the third struts, and, a bolt and nut for fastening the fourth width portion to a headboard of the wall bed.

12. A mechanism as claimed in claim 1, said first guide means comprising a pair of longitudinal members, respectively, fixed to said third width portion and spaced in abutting relation with said rollers of the third struts; said guide means having a series of three holes sized and spaced to fit onto said second and third portions and first pivot means; said guide means being freely rotatable about said first pivot means.

13. A mechanism as claimed in claim 1, said tensioning means comprising one to three springs and two rope or wire means; said springs having a distal and proximal end; said distal end of the springs having attachment means, such as hooks, attaching to said holes at the distal end of the second struts; said proximal end of the springs having attachment means, such as hooks, attaching to said second securing means on said first width section of the second struts; said springs being sized to develop tension as they are extended between the proximal and distal ends of the second struts;

said rope or wire means comprising two ropes, wires, or like material and having proximal and distal ends; said distal end of the rope means fastening to said third securing means on said first width section of the second struts; said proximal end of the rope means looping between said rollers and the third width portion of the third struts, and, fastened to said adjustable width section of the first struts.

14. A lifting mechanism for supporting and accommodating pivotal motion of a wall bed into the reclining and storage positions with respect to a wall bed cabinet having an interior base portion to which the wall bed is affixed, said mechanism comprising a support means including a first pair of longitudinal struts spaced a first pre-determined distance apart;

each first strut having an upper and lower portion, inner and outer surface, and, forward and rearward vertical support portions; said inner surface of each strut facing the respective inner surface of the other strut; said upper and lower portions having forward and rearward portions; said forward portions having leading forward edges, and, said rearward portions having leading rearward edges; said leading forward edge of the upper portions being spaced a second pre-determined distance forward of said leading forward edge of the lower portions; said leading rearward edge of the lower portions being spaced a third pre-determined distance rearward of said leading rearward edge of the upper portions; said forward and rearward vertical support portions spacing the upper and lower portions a fourth pre-determined distance apart;

said leading forward edges of the lower portions having a first width-wise portion bridging said first pre-determined distance, said first width-wise portion including a spacing means; said first width-wise portion having an upper and lower surface, a pair of threaded holes symmetrically spaced between said first struts and connecting the upper and lower surface, and, a pair of bolt-like members mating with said holes, said bolt-like members having bolt heads adjustable with a wrench or similar device, said bolt heads being adjustably spaced beneath the lower surface of the first width-wise portion;

said leading rearward edges of the lower portions having a second width-wise portion bridging said first pre-determined distance;

said vertical portions having forward and rearward surfaces, holes spaced a fifth pre-determined distance between the upper and lower portions and connecting the forward and rearward surfaces, and, elongate bolts and frozen nuts connecting the forward surface of each forward vertical support to the respective rearward surface of the rearward vertical support, said holes being sized to accommodate the free turning of the bolts;

an adjustable width-wise section adjustably mating through nut or other threaded means said elongate bolts, such that as said bolts are adjusted with adjustment means, said adjustable section is moved forward or rearward between the vertical supports;

a first pivot means, said first pivot means comprising a first pin; said first pin bridging said first pre-determined distance and rotatably attached to said leading forward edges of the upper portions;

a second pivot means, said second pivot means comprising a second pin, said second pin bridging said first pre-determined distance and rotatably attached to said lower portion a sixth pre-determined distance rearward of the leading edge of the lower portion;

a first attachment means for securing the lower, forward portion of the first struts to said interior base portion of the wall bed cabinet, and, comprising a pair of L-shaped longitudinal members, respectively, spaced in abutting relation with the outer surfaces of the first struts and pivotally attached to said struts by said second pivot means;

each longitudinal member having an upper, lower, forward, and rearward portion; said lower portion extending away from the respective outer surface of the first struts, and, having a lower and upper surface and a hole connecting the lower and upper surface of the longitudinal member, said lower surface designed to be placed in flush relation with said interior base portion, and said hole being sized to accommodate a bolt for securing the first attachment means to said interior base portion of the wall bed cabinet; said upper portion having an inner and outer surface and a hole connecting the inner and outer surface, said hole being spaced along the rearward portion of the longitudinal member, said inner surface spaced in flush relation to said outer surface of the respective first struts and said hole being sized to fixedly mate with said second pivot means;

a second attachment means for securing the leading rearward edge of the lower portion of the first struts to said interior base portion of the wall bed cabinet, and comprising an L-shaped bracket member including means for securing the bracket member to the interior base portion of the wall bed cabinet; said bracket member having a central and two distal portions, said central portion having an L-shape, a horizontal surface for abutting relation with the rearward, lower portion of the first struts, and a vertical portion for abutting relation with a rear, interior wall of the wall bed cabinet; said horizontal surface of the central portion having an upper and lower face, a threaded hole centrally located and connecting the upper and lower face, and, a bolt threaded for mating engagement with said hole for adjustable engagement with the rearward, lower portion of the first struts; said distal portions having an L-shape, a vertical face sized to abut the respective outer surfaces of the first struts, and a horizontal portion including a hole, said horizontal portion being sized to engage the interior base portion in flush relation, and said holes being sized for mating engagement with a bolt and nut for securing the bracket to the interior base portion in flush relation;

a rotating structure, attaching to the base of said wall bed and pivotally attached to the support structure by said first pivot means, comprising a second pair of longitudinal struts spaced a seventh pre-determined distance apart less than said first pre-determined distance;

each second strut having a proximal and distal end, and, an inner and outer side; said inner side having a slot extending longitudinally;

said inner side of each second strut facing the inner side of the other second strut;

a first width-wise portion bridging said seventh pre-determined distance at said distal end of the second struts and including a first securing means; said first securing means comprising three symmetrically spaced hole between the inner sides;

a first width-wise section bridging said seventh pre-determined distance and being slidable within said slot of the second struts; said first width section including a second and a third securing means; said second securing means comprising three symmetrically spaced holes on the first width section, between the inner sides and corresponding to said three holes on said first width portion; said third securing means comprising two symmetrically spaced holes between the inner sides and corresponding to the proximal end of the second struts;

a third pair of longitudinal struts spaced a seventh pre-determined distance apart, fixed in perpendicular relation to said second struts at a fixation point, and pivotally connected to the support means by the first pivot means;

each of said third struts having a proximal and distal end, and, an inner and outer side; said inner side of each strut facing the inner side of the other; said third strut including a hole connecting the inner and outer side at the proximal end, said holes being sized to mate with said first pivot means and permit free rotation of said rotating structure from a first degree relation to a second degree relation with respect to the first struts;

said fixation point being located nearer to the proximal than the distal end of the third struts;

a second width-wise portion bridging said seventh pre-determined distance adjacent the fixation point and towards the proximal end of the third struts; said second width portion comprising a rod and two rollers spaced adjacent respective inner sides of the third struts; said rollers having free rotation about the third width portion;

a third width portion adjacent the second width portion and towards the distal end of the third struts; said third width portion comprising a rod;

a fourth width-wise portion bridging said seventh pre-determined distance and including a securing means, said securing means comprising a hole centrally located between the inner sides and facing perpendicular to the third struts, and, a bolt and nut for fastening the fourth width portion to a headboard of the wall bed;

a first longitudinal guide means comprising a pair of longitudinal members, respectively, fixed to said third width portion and spaced in abutting relation with said rollers of the third struts; said guide means having a series of three holes sized and spaced to fit onto said second and third portions and first pivot means; said guide means being freely rotatable about said first pivot means; and, a tensioning means, connecting said rotating structure and said support means to provide tension on the rotating structure as said structure is disposed from said first degree relation to said second degree relation with respect to said support means; said tensioning means comprising one to three springs and two rope or wire means; said springs having a distal and proximal end; said distal end of the springs having attachment means, such as hooks, attaching to said holes at the distal end of the second struts; said proximal end of the springs having attachment means, such as hooks, attaching to said second securing means on said first width section of the second struts; said springs being sized to develop tension as they are extended between the proximal and distal ends of the second struts;

said rope or wire means comprising two ropes, wires, or like material and having proximal and distal ends; said distal end of the rope means fastening to said third securing means on said first width section of the second struts; said proximal end of the rope means looping between said rollers and the third width portion of the third struts, and, fastened to said adjustable width section of the first struts;

whereby said rotating structure accommodates pivotal motion of the wall bed about an axis along said first pivot means and above said cabinet base portion so that the rotating structure assumes the first degree relation when the wall bed is stored in the wall bed cabinet, and assumes the second degree relation under increasing tension as the wall bed assumes the reclining position.

* * * * *